United States Patent [19]

Willcox

[11] Patent Number: 4,457,637

[45] Date of Patent: Jul. 3, 1984

[54] SQUEEZE PRINTING MECHANISM

[76] Inventor: Frederick P. Willcox, 565 Oenoke Ridge, New Canaan, Conn. 06840

[21] Appl. No.: 422,923

[22] Filed: Sep. 24, 1982

[51] Int. Cl.[3] ..... B41J 1/02; B41J 9/28

[52] U.S. Cl. ..... 400/172; 400/386; 400/388; 400/391.2; 400/403; 400/428; 400/430.2; 400/433

[58] Field of Search ..... 400/386, 388, 391.2, 400/389, 364, 402, 403, 428, 166, 430.2, 430.3, 433, 437, 172

[56] References Cited

U.S. PATENT DOCUMENTS

| | | | |
|---|---|---|---|
| 1,282,410 | 10/1918 | Going | 400/433 |
| 1,312,821 | 8/1919 | Anderson | 400/386 |
| 1,487,300 | 3/1924 | Walton | 400/172 |
| 1,531,103 | 3/1925 | Kidder | 400/391.2 |
| 1,657,626 | 1/1928 | Hokanson | 400/391.3 |
| 1,776,794 | 9/1930 | Myers | 400/391.3 |
| 1,817,254 | 8/1931 | Going | 400/386 |
| 1,846,339 | 2/1932 | Joerissen | 400/427 |
| 2,060,719 | 11/1936 | Bates | 400/403 |
| 2,621,772 | 12/1952 | Reppert | 400/166 |
| 3,373,857 | 3/1968 | Lapointe | 400/364 |
| 3,469,124 | 9/1969 | Willcox . | |
| 3,731,778 | 5/1973 | Willcox | 400/172 |
| 3,892,303 | 7/1975 | Willcox | 400/172 |
| 3,918,568 | 11/1975 | Shimodaira | 400/166 |
| 4,047,607 | 9/1977 | Willcox . | |
| 4,332,489 | 6/1982 | Dollenmayer | 400/172 |

FOREIGN PATENT DOCUMENTS

| | | | |
|---|---|---|---|
| 14529 | 5/1956 | Fed. Rep. of Germany | 400/172 |
| 1141300 | 12/1962 | Fed. Rep. of Germany | 400/389 |
| 1274137 | 8/1968 | Fed. Rep. of Germany | 400/389 |
| 107489 | 8/1980 | Japan | 400/172 |

*Primary Examiner*—William Pieprz
*Attorney, Agent, or Firm*—William D. Hall

[57] ABSTRACT

A printer is fitted with a squeeze printing mechanism employing a toggle or over-the-center crank mechanism to provide direct pressure to a printing element for accurate impression depth control during imprinting and for achieving low velocity at the time of print element contact with the paper to materially reduce printing noise. Mechanism and linkages are provided for either single or double electromagnetic actuators. The linkages are arranged to provide rectilinear movement of the type face bearing element just prior to and during imprinting. Over pressure relief is provided for the toggle or over-the-center crank mechanism to prevent damage or lock-up if the printer platen position is not correctly adjusted for the paper being used.

7 Claims, 14 Drawing Figures

10
42
46
44
25
24
58
60
54
52
12
62
64
68
26
28
30
48
50
56
38
36
25
39
32
34
40
74
70
76
72
16
14
22
20
18
80
78
66

10
12
37
39
90
56
60
88
70
94
66
82
76
92
96
84
74
77
72
98
80
80
16
18
81
83
86
78
100
22
14
86
20
102

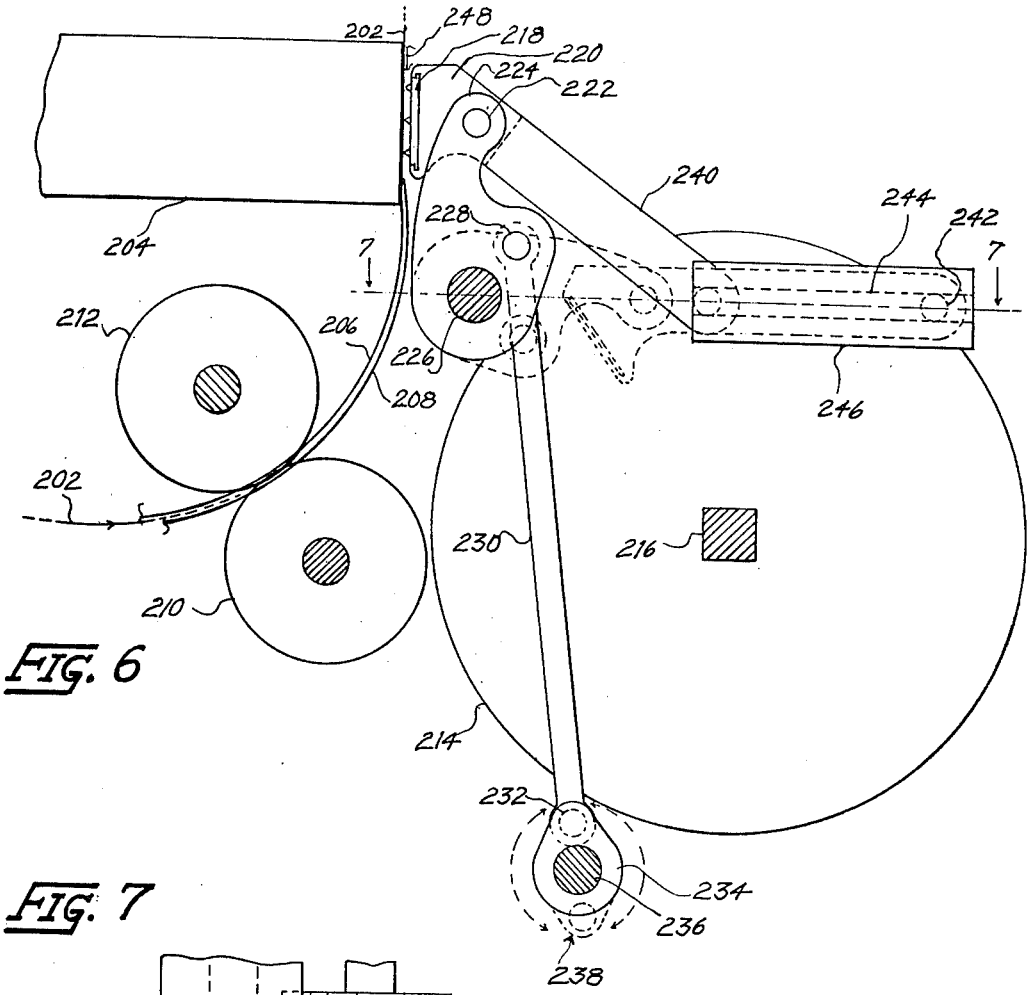
FIG. 6
FIG. 7
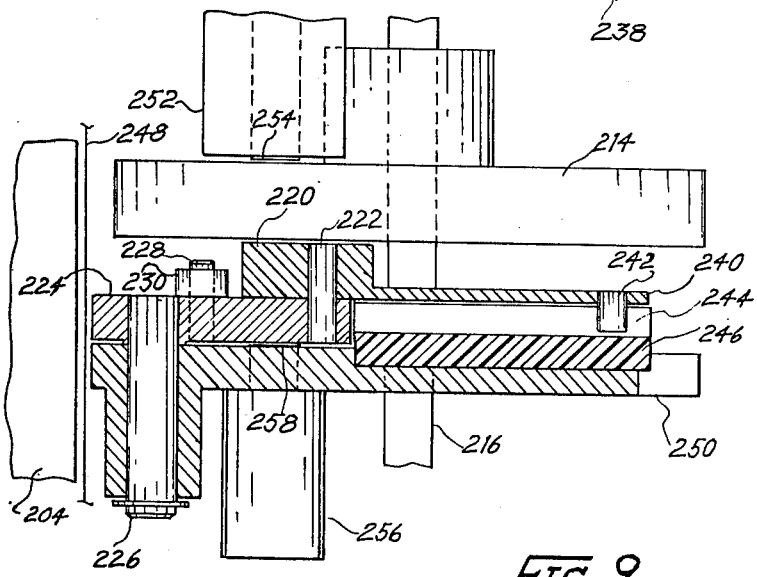
FIG. 8
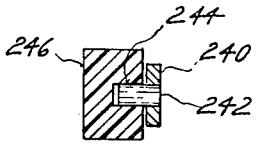
FIG. 9
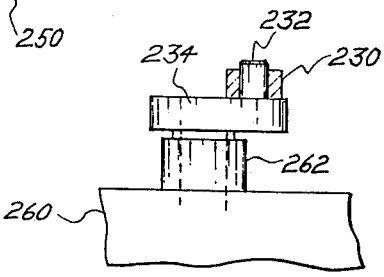

SQUEEZE PRINTING MECHANISM

SUMMARY OF THE INVENTION

This invention solves the general problem of printing depth variations which are due to the widely varying type face areas of the characters making up most type fonts by using a crank structure operating as an over-the-center mechanism or a similar toggle lever and link construction to control and precisely limit type face travel. The problem of top-to-bottom impression depth variations are solved by providing essentially rectilinear movement of the type face bearing member just prior to and during imprinting. This is achieved by using either a second crank or a sliding structure to control the movement of a crank-supported impressing member that either supports a type face bearing element or presses against it. Peak printing pressure control is provided by supporting the toggle lever or its equivalent upon a pre-loaded resilient member to secure pressure relief if the platen is adjusted too far forward for the thickness of the record material being used. One or two electromagnetic actuators are used to effect imprinting depending upon the specific construction employed. Printing noise is reduced by using very short cranks to get low type face velocity at the time of interference between the type face and the surface of the record material.

DESCRIPTION OF THE DRAWINGS

FIG. 6 is a left elevation of a portion of a printer using a more simple form of squeeze printing mechanism with a 90° crank and 360° over-the-center drive, also arranged for imprinting with individual type chips.

FIG. 7 is a partially cross-sectioned top view of the mechanism in FIG. 6 taken along the linkage center line 7—7.

FIG. 8 is a cross-section detail of the guide groove for the sliding end of the type chip carrier.

FIG. 9 is a partial top view of the 360° crank drive of FIG. 6.

DETAILED DESCRIPTION

The squeeze printing mechanisms of this invention are primarily intended for use in printers or typewriters which employ a type font structure wherein each selected type face can be individually moved to effect imprinting therewith. Such type font structures and printers are shown in my U.S. Pat Nos.:

3,731,778 May 8, 1973, "Printer Having Individual Character Chips,"

3,534,847 Oct. 20, 1970, "High Speed Teleprinter," and 3,892,303 July 1, 1975, "Type Font Changing Mechanism and Controls."

These three patents are incorporated herein by reference. In addition, another type font structure which can be so classified is the so-called "daisy wheel" which has the indivdual type faces supported on the ends of spokes of a wheel. Such a spoked wheel is shown, for example, in my U.S. Pat. No. 3,461,235 Aug. 12, 1969, "Data Transmission System and Printer."

In the first patent listed above, the type faces are on respective chips which are stored in a drum which is rotated for chip selection to a position where the chip is pushed out of the drum into an impression member which moves the chip to the imprinting position. In the second patent listed above, each type face is carried on the end of a respective arm of a plurality which are stored para-axially in a spool-shaped carrier and a selected arm is swung out through an angle of 90° and the distal end is then pressed against the record material.

Figure 1:
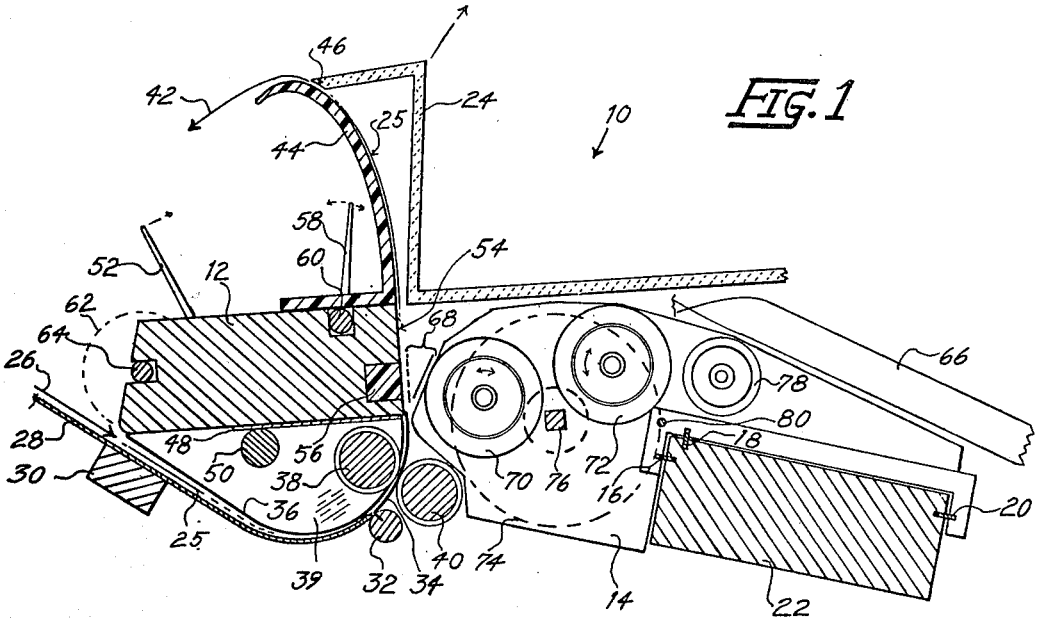
FIG. 1 shows a partial cross-section elevation, taken from the left side, of a printer incorporating a rigid flat platen bar and a single rigid carriage support bar having three kinematically arranged guideways with a squeeze printing mechanism carriage slidably supported thereon for printing with individual character type chips.

FIG. 1 shows the essential elements of a printer, generally designated by the numeral 10, which is designed to print with individual character chips as shown in the referenced U.S. Pat. No. 3,731,778. To accomplish this objective, the printer 10 is fitted with a massive platen bar 12 having a generally flat face in the writing area. A print carriage 14 is slidably supported on three narrow guide rails; front rail 16, top rail 18, and back rail 20, which are fixed in a massive carriage support bar 22. A transparent printing area cover 24 provides part of the radiated noise reduction system of the printer. This cover 24 is hinged, by means not shown, to either part of the printer case or to the upper edge of the keyboard support, also not shown, and may be swung upward and away from the printing area for access thereto.

The input path for a record material 25 is indicated by arrow 26 and is directed to the writing line along the face of platen bar 12 by inner and outer paper guides. Outer guide 28 is supported by fixed transverse bars 30 and 32. A thin springy outer front paper guide 34 is also supported by bar 32 and serves as a flexible extension of outer guide 28. An inner paper guide 36 is retained on two lateral ribs 37 and 39, the right rib 39 shown in this figure, which are attached to the bottom of platen bar 12, and completes the paper or record material in-feed channel and directs the paper between the spring-loaded inner feed roller 38 and the driven outer feed roller 40 and thence to the printing area.

The record material exit path is indicated by arrow 42. Record material leaving the writing line or printing area is guided along the front surface of specially curved exit guide 44 and may be loosely confined thereto by the upper edge 46 of cover 24. Alignment of the top edge of an inserted piece of record material is obtained by a paper alignment guide 48 which is temporarily projected into the infed record material path just below the writing line as it exits from between inner guide 36 and front guide 34. Alignment guide 48, which is slidably supported, cooperates with a shaft 50 which is part of the lifting mechanism, not shown, which separates the feed rollers 38 and 40 for record material loading. Shaft 50 is connected to lever 52 which is rotated clockwise by the operator before record material insertion and released after record material alignment against guide 48. The releasing action or counter-clockwise rotation of shaft 50 retracts alignment guide 48 and effects re-engagement of the feed rollers 38 and 40.

Platen bar 12 has a generally flat face 54 in the printing area for backing up and supporting the record material along the writing line although the face may be curved convexly as shown in FIG. 24 of the referenced U.S. Pat. No. 3,534,847. Platen bar 12 may have a slightly resilient back-up surface behind the writing line such as insert 56 which may be of a plastic such as nylon. Platen bar 12 is adjusted for the thickness of the record material by lever 58 attached to shaft 60. Platen bar 12 may be tilted for top-to-bottom impression depth control by means of a possible knob 62, shown dotted line, attached to a transverse shaft 64. Both shafts 60 and 64 are fitted with eccentrics on each end thereof which engage respective slots or holes in the printer frame structure which supports the ends of platen bar 12.

A ribbon is generally indicated at 66. In the printing area between the carriage 14 and platen face 54, the ribbon can assume one of two positions, solid line and dotted line collectively indicated at 68. The solid line position is assumed when at rest or during transport. During imprinting, the print mechanism pushes the ribbon to the approximate dotted line position parallel to the face of the platen 12 and the record material.

The print carriage 14 has a mechanism for making a line of imprints with individual type chips as shown in the referenced U.S. Pat. No. 3,731,778 and may have a printing mechanism similar to that shown schematically in this reference, or may have a squeeze printing mechanism, details not shown in this figure, which is operated by a primary actuator 70 and a secondary actuator 72. Carriage 14 laterally retains a type font drum 74 which is slidably supported on a square drive shaft 76. A type font comprising a plurality, ninety-six for example, of type chips, each having a type face, are accessably stored in drum 74. The font drum 74 is rotated by a stepping motor 77 to selectively position a desired type chip for retrieval and printing therewith as shown the referenced U.S. Pat. Nos. 3,731,778 and 3,892,303. In printer 10 a selected type chip is pushed out from its storage position in drum 74 by means of solenoid 78 which linearly acts on a narrow blade which enters a slot in the back of drum 74 to act upon the selected type chip. The electromagnetic actuators 70 and 72 are of the limited angle rotary type and may be of the type generally shown in my U.S. Pat. No. 3,469,124 Sept. 23, 1969, "Multistage Impulse-Operated Rotary Stepping Motor."

In FIG. 1, the printer 10 is tilted back about 5° for good lighting of the writing area, and also to cause the record material 25 to naturally lay against exit guide 44.

Figure 2:
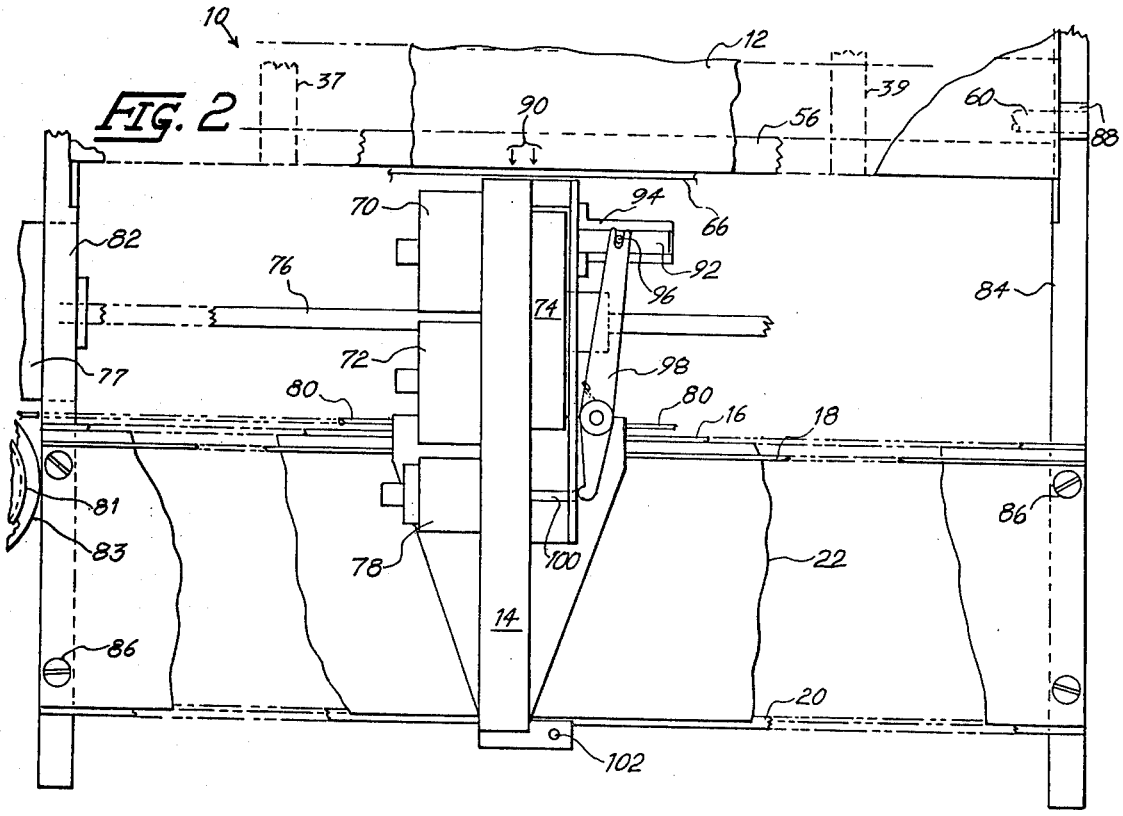
FIG. 2 is a partially cutaway top view of the printer with the platen bar rotated forward 15° so that its face is normal to the plane of the support bar for illustrative clarity.

In FIG. 2 the general planform of printer 10 can be seen. The carriage support bar 22 may be attached to the left and right side plates 82 and 84, respectively, by screws 86, or preferably side plates 82 and 84 would be integral with the carriage support bar 22 as a casting. Side plates 82 and 84 are appropriately machined and fitted to retain the platen bar 12 and to provide bearing surfaces for the adjustment eccentrics on the ends of shafts 60 and 64. One such eccentric is indicated at 88 and is on the righthand end of shaft 60. Another similar eccentric is on the lefthand end of shaft 60.

The approximate instant print area on platen bar 12 is defined by the twin boundry arrows 90. Type chips are removed from the font drum 74 and injected into the print mechanism by blade 92 which slides in support 94. Blade 92 has a projecting pin 96 which is engaged by lever 98 which, in turn, is moved counter-clockwise to inject a type chip by means of solenoid 78 acting through push rod 100 and restored by a spring.

Carriage 14 is positioned along bar 22 and hence along the writing line by a cable drum 81 on a stepping motor 83 acting through cable 80. This type of carriage positioning mechanism is shown in more detail in the referenced U.S. Pat. No. 3,892,303.

The back end of carriage 14 has a hole 102 in the guide extension for engaging an articulated ribbon guide member such as that shown in my U.S. Pat. No. 4,047,607 Sept. 13, 1977, "Articulated Ribbon-Guiding Structure." The on-carriage ribbon guides can be positioned in a manner similar to those shown schematically in that patent. If the ribbon 66 is brought up and over the carriage 14 as shown in FIG. 1, the on-carriage ribbon guides are made of partially twisted metal strips to effect a vertical bend in the ribbon path as is well-known in the art.

Figure 3:
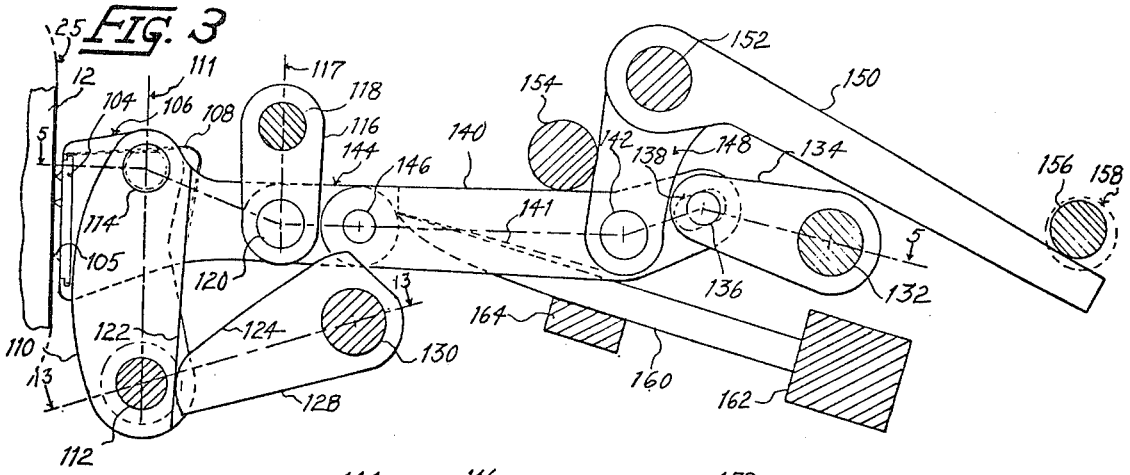
FIG. 3 shows a toggle squeeze printing mechanism with the linkage in the imprinting position using an individual type chip.

Referring now to the details of the squeeze printing mechanism shown in FIG. 3, the crank, lever, and linkage assembly is shown in the imprinting position. A type chip 104 is retained in an impressing member 106 and biased toward the bottom edge of member 106 by a spring 108 which is fastened to member 106. A primary crank 110 which rotates through a limited angle of about 41° on shaft 112 has a projecting pin 114 fixed in the distal end thereof which supports member 106 for movement from the chip loading position to the imprinting position. A secondary crank 116, pivoted on shaft 118, has a pin 120 fixed in the end thereof for further supporting member 106 and converting the curvilinear movement to essentially rectilinear movement of the member 106.

Primary crank 110 has a flat surface 122 which is engaged by a rocking cam surface 124 on cam 128 which is fastened to a shaft 130 which, in turn, is attached to the rotor of actuator 70. Cam 128 rotates clockwise through a small angle of about 13° to impart a counter-clockwise movement to crank 110. The rotor of secondary actuator 72 is attached to shaft 132 which is, like shaft 130, journalled in the center pole of the actuator, and has a small crank 134 firmly pressed onto the other end thereof. This small crank 134 has a crank pin 136 which engages a slot 138 in the short end of toggle lever 140. Crank 134 rotates clockwise through an angle of about 25° to drive toggle lever 140 counter-clockwise through an angle of about 41° to the imprinting position as shown. Toggle lever 140 rotates on pivot pin 142, to be described, to also drive impressing member 106 into the imprinting position by acting through a toggle link 144 pivoted on crank pin 146 in the end of lever 140 and also on the crank pin 120 of the secondary crank 116.

The toggle lever 140 and toggle link 144 are shown on dead center position in FIG. 3. This is the position of maximum squeeze or pressure on the type chip 104 and impression depth of type face 105 into record material 25, assuming, of course, that the position of platen 12 is properly adjusted for the thickness of record material 25.

The pivot pin 142 for toggle lever 140 is firmly secured in the crank end 148 of loading lever 150 which is supported on a pin 152 retained in the frame of carriage 14. This loading lever 150 is essentially an extremely stiff spring and is limited in rotation by a limit stop 154 also firmly retained in the frame of carriage 14. The long springy end of loading lever 150 bears against an eccentric pin 156 which is retained in the frame of carriage 14. The nature of the eccentric portion of pin 156, indicated by the dotted line circle 158, is such that a specific initial pressure can be applied to impressing member 106 when toggle lever 140 and toggle link 144 are on dead center before the loading lever crank end 148 leaves the limit stop 154. For a ten or twelve point capital "M" this initial pressure may exceed 30 lb. (13.5 kg) for example. The primary purpose of loading lever 150 is to prevent over-pressure on impressing member 106 from damaging the linkage, and secondarily to aid or enable toggle lever limit spring 160 in "kicking" toggle lever 140 back off dead center and thus prevent an over-the-center lock-up of toggle lever 140. The toggle lever limit spring 160 is a short piece of music wire having a square cross-section, nominally about 0.062 in. (1.5 mm). Spring 160 is retained in a fixed boss 162 on the frame of carriage 14. A limit stop 164, also a boss on the carriage frame, alters the response of spring 160 to any over-swing of toggle lever 140. Lever 140 has a recessed, centrally located, portion 141 which engages spring 160 just prior to the lever 140 comming on dead center. The limit stop 164 is positioned so that it just touches spring 160 when toggle lever 140 is on dead center.

At the same time the toggle lever 140 and toggle link 144 are on dead center, the center line 111 of primary crank 110 and the center line 117 of secondary crank 116 are exactly parallel. It can thus be seen that for quite small angles of rotation of cranks 110 and 116 when the toggle lever 140 and link 144 are about to come on dead center that the face of type chip 104 remains parallel to the face 54 of platen 12 for a distance of about 0.020 in. (0.5 mm) or slightly more for all practical purposes. Thus type chip 104 is moving along a path normal to face 54 of platen 12 just before interference with the surface of the record material 25 and continues moving in this normal plane for full interference with the record material, a distance of about 0.002 in. (0.05 mm) thus maintaining equal impression depth of the imprint from top to bottom of the type face 105 of type chip 104.

Figure 4:
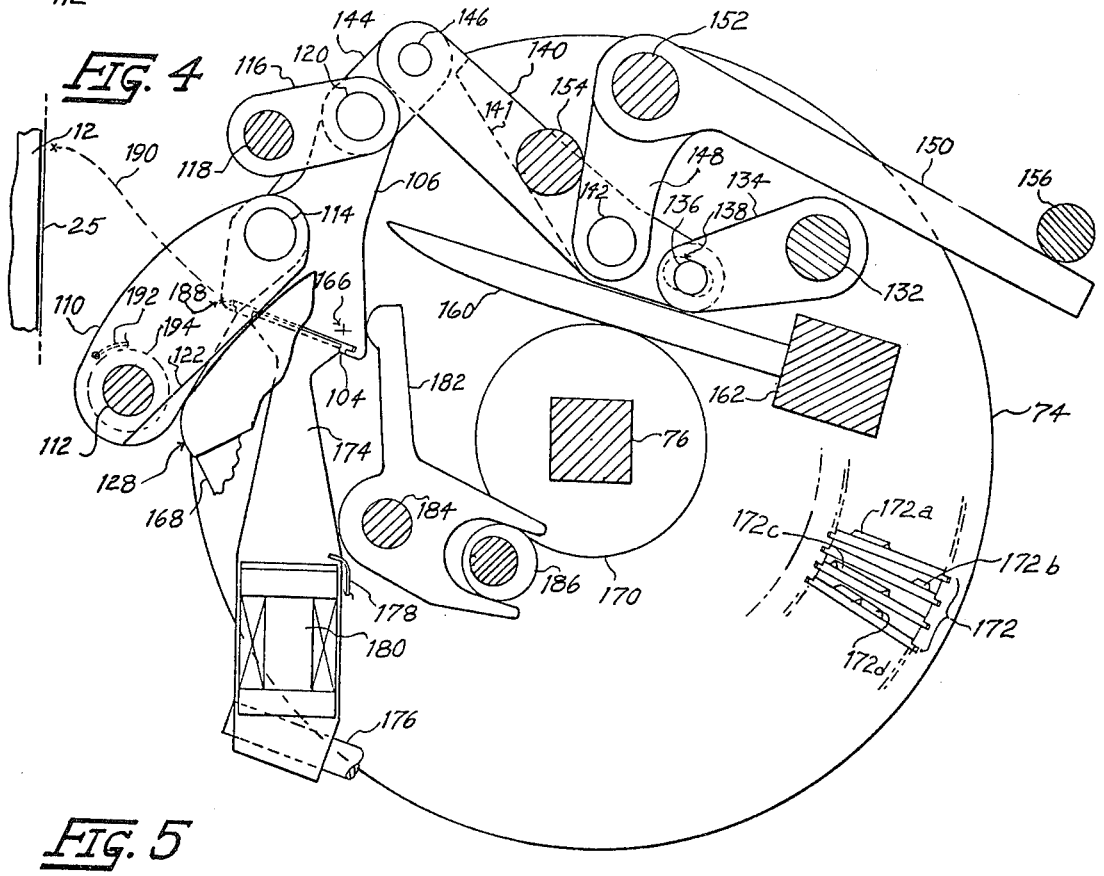
FIG. 4 shows the same mechanism as FIG. 3 but with the linkage at rest in the type chip loading and unloading position.

In FIG. 4, the printing linkage is shown in the rest position which is also the type chip loading and unloading position. In this figure a portion of cam 128 and its drive shaft 130 are not shown in order to clearly show other parts of the printing structure. For reference, the center of shaft 130 is indicated by a small cross 166. Also, the rest position limit stop for cam 128 is indicated at 168. The outline of the type font drum 74, its hub 170, and the font drum drive shaft 76 are shown. The storage positions of four of the ninety-six type chips retained in drum 74 are collectively indicated by the numeral 172 and have respective type faces **172*a*, 172*b*, 172*c*, and 172*d*. In this FIG. 4 the record material 25 is shown spaced from face 54 of platen 12** for illustrative clarity.

Type chip 104 is shown in the loaded position after injection into impressing member 106. The type chip ejector lever 174 has a pivot shaft 176 journalled in the frame of carriage 14 and is normally urged to eject or slide the type chip out of member 106 and back into drum 74 by a spring 178 partly shown. Ejector lever 174 is pushed into the 'eject ready' position when a chip is injected from drum 74 into member 106 and is retained in the 'eject ready' position by a small tractive type electromagnet 180 which is energized during the printing cycle and is, of course, de-energized when member 106 is returned to the rest position after imprinting.

The exact rest position of impressing member 106 directly over the instant chip storage position in the font drum 74 is assured by notched limit crank 182 which is pivoted on a pin 184 retained by the frame of carriage 14.

The curvilinear path of a point 188 on impressing member 106 is indicated by the dotted line 190. Primary crank 110 is lightly urged into the rest position shown in FIG. 4 by a small torsion spring 192 which surrounds the hub 194 of crank 110.

Figure 5:
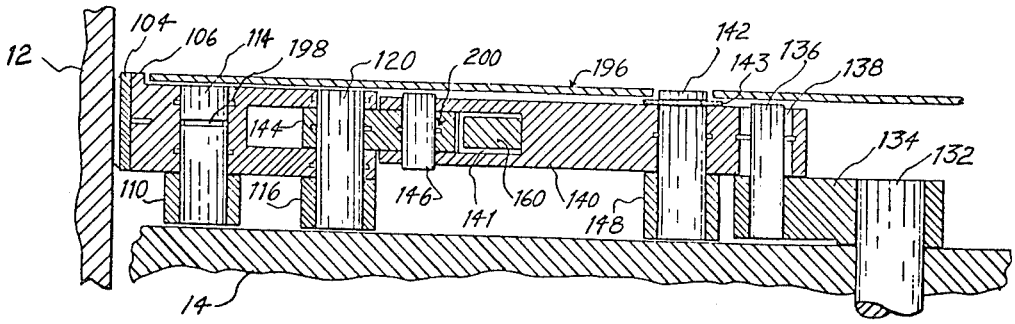
FIG. 5 is a cross-section detail of the linkage shown in FIG. 3 taken along the center section 5—5.

Referring to FIG. 5, a rub plate 196 is spaced from the frame of carriage 14 by stand-off studs, not shown. The open face of the font drum 74 and the type chips stored therein, such as shown at 172 in FIG. 4, can rub lightly against this plate 196 which may have a very hard plated surface such as rhodium or a low coefficient of friction coating such as polytetrafluoroethylene to keep friction at a minimum. The plate 196 is appropriately cut out to clear the head extension of impressing member 106 as well as the type chip during injection or ejection.

Impressing member 106 is retained on crank pin 114 by spring 108, shown in FIG. 3, which engages a circumferential groove 198 in pin 118. FIG. 5 also shows how the back end of impressing member 106 and the end of toggle lever 140 straddle toggle link 144. Further detail of the engagement of crank pin 136 in slot 138 of toggle lever 140 is also shown. A retaining ring 143 retains toggle lever 140 on pivot pin 142 which, in turn, is retained in crank 148 of the loading lever 150. Member 106, link 144 and lever 140 all have recessed oil grooves in the journal surfaces as indicated at 200 for example.

The less complicated form of squeeze printing linkage shown in FIG. 6 can be mounted on a carriage such as carriage 14 in FIG. 1 and supported for positioning along the writing line on a support bar and guide rails generally located lower down than shown in FIG. 1. Paper or record material is indicated at 202 and is guided to the printing back-up surface on platen bar 204 by passing between inner paper guide 206 and outer paper guide 208. The record material is fed by driven feed roller 210 and a spring-loaded inner roller 212, again similar to that of FIG. 1. A type chip font drum 214 and its drive shaft 216 are schematically shown.

Here again, a type chip 218 is slidably supported in the face of an impressing member 220 and is shown in full impression position with type face 219 against record material 202. Member 220 is supported for curvilinear motion on crank pin 222 on crank 224 which, in turn, has a shaft 226 attached thereto which is journalled in the frame of the carriage. Crank 224 also has a second crank pin 228 which is engaged by connecting rod 230. The other end of rod 230 fits on a crank pin 232 of crank 234. A shaft 236, fixed to crank 234, is rotated back and forth alternately, for each printing cycle, through 360° by an electromagnetic flip-flop actuator, not shown, acting through a sector gear and a pinion on shaft 236. The normal or rest position of crank 234 is indicated at the dotted line position 238. The dotted line position for crank 224 is also the rest position at which the type chips are injected into and then ejected from the impressing member 220.

Impressing member 220 has a long tail piece or extension 240 which has a pin 242 fixed in its distal end which engages a slot 244 in a rigid plastic guide 246 supported by the carriage frame. When drive crank 234 rotates through 360°, crank 224 is rotated counter-clockwise through 90° for imprinting and then clockwise back to the rest position for chip ejection and selection of a different type chip in font drum 214. Thus it can be seen that when crank 224 is at its uppermost position, crank pin 232 is on top dead center and squeeze pressure is applied to the type chip 218 during the over-the-center action. During rotation of crank 224, pin 242 slides in slot 244 and thereby controls the curvilinear motion of member 220 from rest to impression and back to rest. Guide 246 could be a cam serving the same purpose. As before, the motion of member 220 is essentially linear along a line normal to the platen face just before and during imprinting.

FIG. 7, in addition to showing a cross-section through the print linkage in the rest position, dotted line position in FIG. 6, shows a portion of platen bar 204, a section of carbon ribbon 248, and carriage frame 250. The position of the chip injector support 252 and injector blade 254, as well as slide and spring housing 256 for ejector slider 258 are also shown.

FIG. 8 shows how the pin 242 in extension 240 of member 220 engages the slot 244 in the plastic guide 246. The plastic guide 246 would desirably be made of a material with a low coefficient of friction such as a polytetrafluoroethylene filled acetal.

FIG. 9 shows an electromagnetic bi-directional or flip-flop actuator 260 connected to crank 234. Actuator 260 has a bushing 262, in which shaft 236 is journalled, which fits into a hole in carriage frame 250 thus supporting the drive mechanism. Actuator 260 can be constructed to drive crank 234 through 180° and back to rest for one imprinting action, or can have a sector gear driving a pinion on shaft 236 and drive crank 234 through an angle of 360° for one imprinting action and then back in the opposite direction for 360° for the next imprinting action.

Figure 10:
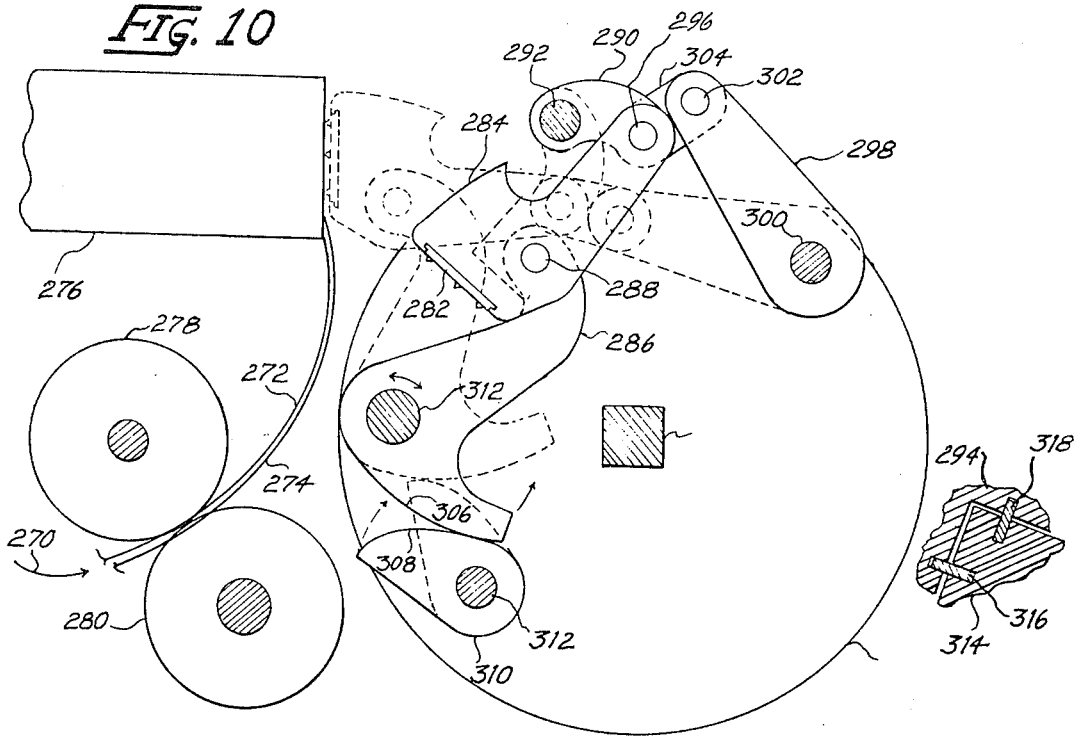
FIG. 10 is a left elevation of a portion of a printer incorporating a squeeze printing linkage similar to that of FIG. 3 but simpler and arranged to use 41° electromagnetic actuators.

FIG. 10 shows a print linkage similar to FIG. 3, but with the linkage at rest in solid line position and in dotted line position at the moment of full impression depth. The record material input path is indicated by arrow 270. In-fed record material enters between inner paper guide 272 and outer paper guide 274 and is fed past the face of platen bar 276 by feed rollers 278 and 280. The type chip 282 is slidably supported in the face of impressing member 284 which straddles the end of primary crank 286 and is retained thereon by crank pin 288. A secondary crank 290 fixed to a shaft 292 journalled in the frame of carriage 294 (partially shown), has a crank pin 296 which supports one end of impressing member 284 to control the curvilinear motion of member 284. A toggle crank 298, fitted on one end of shaft 300 which engages the secondary actuator rotor, (to be shown), has a crank pin 302 on which is pivoted a short toggle link 304. The other end of toggle link 304 also rotates on crank pin 296.

Primary crank 286 has a rocking cam portion 306 which is engaged by a cooperating rocking cam portion 308 on a driving cam 310. A shaft 312 is fixed to cam 310 and connected to the rotor of the primary actuator, (to be shown). When cam 310 is driven clockwise through an angle of about 41°, it drives primary crank 286 counter-clockwise through an equivalent angle to effect imprinting. At the same time cam 310 is being driven, toggle crank 298 is also driven through an angle of about 41° to apply force through toggle link 304 to impressing member 284. As with the mechanism in FIGS. 3 and 4, maximum squeeze pressure is applied to the type chip 282 when the toggle crank 298 and toggle link 304 come on dead center position and the depth of the imprinting impression is accurately limited. The counterclockwise rotation of toggle crank 298 is limited by a stiff spring similar to limit spring 160 as previously shown and described.

FIG. 10 also shows the relative position of a carriage support bar 314 with front guide rail 316 and top guide rail 318 of the three guide rails engaging print carriage 294. The rest of the outline of carriage 294 has been omitted for illustrative clarity of the mechanism.

Figure 11:
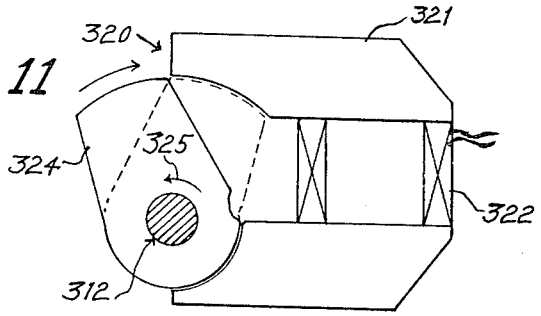
FIG. 11 is a planform view of a 41° electromagnetic actuator for applying power in one direction of rotation as used in the mechanism of FIG. 10.

FIG. 11 shows the internal arrangement of the primary actuator 320 which is supported on the frame of carriage 294. This form of electromagnetic device has a "U" shaped stator 321, an electric winding or coil 322, and a rotor 324 which is rotated through an angle of 41° when coil 322 is energized. The rotor 324 is fixed onto shaft 312 to operate drive cam 310. Maximum torque from this type of actuator is at the start of rotation to achieve maximum acceleration of the driven parts. A return spring, not shown, applies restoring torque in the direction of arrow 325.

Figure 12:
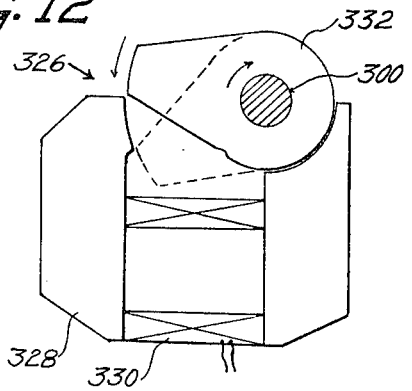
FIG. 12 is a planform view of a 41° rotation electromagnetic actuator similar to that of FIG. 11, but arranged to apply power for half the rotation angle in one direction and then for the first half of the rotation angle in a reverse direction.

FIG. 12 shows the internal arrangement of the secondary actuator 326 which has a stator 328, a coil 330, and a rotor 332 which is fixed onto shaft 300 to drive toggle crank 298. The rotor 332 has a total swing of about 41° but applies torque during the first half of its rotation and coasts through the second portion of the rotation, (with the coil de-energized during the coasting, of course). As used in this application, actuator 326 aids the primary actuator in imparting a high velocity to the print linkage, with kinetic energy being used to drive toggle crank 294 and toggle link 304 onto dead center position for maximum squeeze on the type chip 282. Just before crank 298 and link 304 come on dead center, the coil 330 is re-energized so that counter-clockwise torque is applied to toggle crank 298 to initiate return of the print linkage to its rest position as shown in FIG. 10. When rotor 332 reaches its mid-position on this return stroke, coil 330 is de-energized and then momentarily re-energized just before the linkage reaches its rest position to counter the kinetic energy and bring the linkage to a smooth stop. At the same time, or nearly so, the coil 322 is also re-energized momentarily to apply a counter torque to rotor 324. By this combination of actuator operation the print linkage is driven to imprinting position to make an impression and then back to its rest position and smoothly stopped without bounce.

Referring back to FIG. 1, the rotary actuators 70 and 72 are arranged to operate in a manner similar to that just described, to drive the print linkage shown in FIGS. 3 and 4.

Further, the actuator 260 of FIG. 9, as applied to the print linkage of FIG. 6, is similar to that shown in FIG. 12 except that it is larger and may have a double-ended rotor in lieu of the single-ended rotor 332. With the print linkage of FIG. 6 actuator 260 is energized to drive crank 234 through 180° or one-half its rotation, with the kinetic energy stored in the rotor of actuator 260 then being used to effect return of the print linkage to its rest position during the second half of rotation of crank 234. Here again, actuator 260 is momentarily re-energized to bring the entire mechanism to a rapid but smooth stop without bounce.

Figure 13:
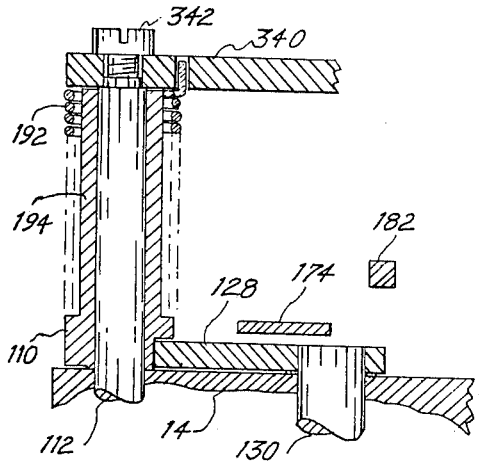
FIG. 13 is a cross-section detail of the primary crank and cam of the mechanism in FIG. 3 taken along the center line 13—13.

Referring now to FIG. 13, which shows additional detail of the squeeze printing linkage of FIG. 3, and to the cross-section view in FIG. 5, a back plate 340 is spaced from the frame of carriage 14 and supported by stand-off studs, not shown, to primarily supply support to the ends of shafts 112 and 118 and to support parts of the injector mechanism previously described. In FIG. 13 crank 110 is in the imprinting position at full impression depth and it can be seen how cam 128 engages the surface 122 on crank 110. The section through ejector lever 174, is of course, in the position where it is being held by the traction electromagnet 180. Also the relative position of the limit crank 182 can be seen. Screw 342 holds plate 340 on the end of shaft 112.

FIG. 13 also shows how the primary crank 110 is fitted with the spring 192 surrounding the hub 194 of crank 110, and how it is anchored in back plate 340. Here, the spring 192 may be said to be fitted to the back of primary crank 110. Now referring to FIG. 7 of the mechanism of FIG. 6 and particularly to the mechanism of FIG. 10, a spring similar to spring 192 may be fitted to the front of primary crank 286 to aid in returning the print linkage to the rest position after imprinting and to hold the crank 286, and hence impressing member 284, in exact position for injection and ejection of type chips. In FIG. 7, a spring for exactly the same purpose may be fitted around the boss on carriage frame 250 which supports shaft 226 and engage the protruding end of shaft 336. In this latter case, the return spring would be somewhat lower in torque than that used for the mechanisms shown in FIGS. 3 and 10.

The driven feed rollers 40, 210, or 280 as shown in FIGS. 1, 6, and 10 respectively, may be driven by a stepping motor such as either motor 77 or 83 in FIG. 2, or by an incremental feeding electromagnet or solenoid such as shown in FIG. 23 of my referenced U.S. Pat. No. 3,534,847.

Figure 14:
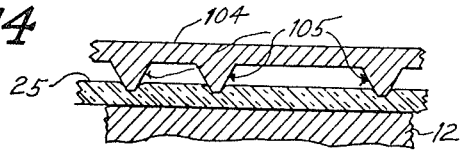
FIG. 14 is a partial cross-section of the type chip, record material, and platen of FIG. 3 with the thickness of the type face and record material exaggerated to illustrate the depth of impression during imprinting.

FIG. 14 illustrates how the type face 105 of the type chip 104 of FIG. 3 depresses and compresses the record material 25 during imprinting. A portion of platen 12 backs up the record material 25 along the writing line. The carbon ribbon 66 is omitted for clarity. The desired depth of the impression varies, of course, with the thickness and nature of the record material. This depth is adjusted by moving the platen 12 toward or away from the print carriage 14 by means of lever 58, shown in FIGS. 1 and 2, along with shaft 60 and eccentrics 88, and maintained quite precisely by the toggle or over-the-center mechanisms as previously described.

From the foregoing description of the preferred embodiments, it can readily be seen that many variations of linkage arrangement and structure are possible without departing from the spirit of the invention. For example, the linkages of FIGS. 3 and 10 can be operated by connecting rods connecting the respective cranks and actuators. In the same figures, the cam drive to the primary cranks can be omitted and the primary actuators fitted directly to the respective cranks, particularly if an actuator 320 as shown in FIG. 11 is used.

A major variation of linkage structure and usage is to eliminate the toggle lever 140 and link 144 of FIG. 3 structure and toggle crank 298 and link 304 of the FIG. 10 structure as well as their respective secondary actuators and then drive the primary cranks 110 or 286 directly to use the linkages in straight impact printing without the squeeze mechanism. This retains the advantage of individual type chip handling and the even impression depth control provided by the secondary cranks 116 or 290 which control the motion of the respective impressing members whther or not they are designed to carry a type chip.

Another variation is specifically applicable to the linkage structure of FIG. 6. Connecting rod 230 can be eliminated and crank 224 driven through a rack and pinion or a sector gear and pinion, or even directly. Further, an over-the-center crank drive on the actuator need not be used, thus transforming the print linkage of FIG. 6 into an impact printer for either type chips or other type-face-bearing members such as the spokes on a so-called daisy wheel. The rack and pinion, or sector gear and pinion drives can also be applied to the print linkages of FIGS. 3 and 10 for example, whether or not squeeze printing by means of a toggle is retained. Still further, in FIGS. 3 and 10 the secondary actuators can be arranged to drive on the secondary cranks if the squeeze printing toggle parts are eliminated.

Again further, the primary and secondary cranks 110 and 116 of FIG. 3 for example, need not be arranged as shown to achieve the essentially linear course of movement just prior to and during the actual impressing to get even impression depth. Similar primary and secondary cranks supporting an impressing member could both be pivoted on the same side of the impressing member to achieve the same terminal linear motion when used with a daisy wheel or the structure of my referenced U.S. Pat. No. 3,534,847. Primary and secondary cranks can be arranged and connected to an impressing member in a four bar configuration which, in effect, throws the chip over-the-shoulder when moving the impressing member from chip loading position to imprinting position. The squeeze printing linkage can also be applied to a printing structure which employs a so-called golf ball font member, most readily by using a pivoted yoke to support the semispherical type-face-bearing font member and connecting the squeeze linkage to the yoke structure.

With regard to the platen structure, a rigid bar as shown, is preferred. However, the print mechanism described could equally well be used in a printer having a conventional rotating platen with the type faces being conformally curved.

I claim to have invented:

1. In a printer of the type having a frame, a platen retained by the frame for supporting record material to receive a line of imprints, a print carriage supported by the frame and positionable along a path parallel to the platen by means supported on the frame, a font storage device supported by the print carriage and having a plurality of individually selectable character-bearing type chips accessibly stored therein, a transfer station, means on the print carriage for removing a selected type chip from the storage device at said transfer station and then returning the type chip to the storage device after a printing operation, and a printing mechanism on said print carriage for making imprints from serially selected type chips, comprising:

(a) an imprinting member having (i) a print end with a transverse face thereon for supporting and retaining a type chip transferred thereto, and (ii) a control end spaced apart from the print end; said member being movable from said transfer station to an imprinting position and back to the transfer station, (b) a primary crank having a crankpin at an end thereof which supports said imprinting member adjacent said print end for limited rotation thereabout, said primary crank being rotatable through an angle generally less than 45°, (c) a control crank, shorter than said primary crank, having a crankpin at the end thereof for rotatably supporting said control end of said imprinting member, said control crank being rotatable to control the angular position of said imprinting member about said primary crankpin, (d) a toggle crank having a crankpin at the end thereof and rotatable through an angle generally less than 45°, (e) a toggle link connecting the respective crankpins on said control crank and said toggle crank, said toggle link and said toggle crank being arranged to squeeze a type chip against said record material when said imprinting member is in imprinting position, (f) a primary electromagnetic actuator having associated means for driving said primary crank to move said imprinting member from said transfer station to said imprinting position, and (g) a bi-directional electromagnetic actuator connected to drive said toggle crank in a first direction to aid in moving said imprinting member toward said imprinting position, effect said squeeze, and then apply force in an opposite direction to effect return of the imprinting member to said transfer station.

2. In a printing mechanism of the type having a stationary platen and a printing carriage movable parallel to said platen with printing means on the carriage for performing a printing operation on a record medium that is positioned on the platen, said printing means comprising all of the following parts mounted on and carried by said printing carriage:

(a) a font storage device, (b) individual type chips stored by said device, with one such chip for each character to be printed, (c) an impression member having a print end for receiving said type chips one at a time, said member being supported for a combination of rotation and translation in the same plane between a chip-exchange position and a printing position, (d) means for exchanging chips when said impression member is in said chip-exchange position, (e) means pivoted to said carriage, and connected to said impression member adjacent said print end, for at least partially controlling the path of travel of said print end, (f) control means remote from said print end for at least partially controlling said impression member to secure substantially rectilinear movement thereof at said printing position and also to secure the correct angular position thereof at said chip-exchange position, and (g) driving means for effecting said rotation and translation.

3. A printing mechanism as defined in claim 2 in which said driving means comprises means for effecting squeeze printing.

4. A printing mechanism as defined in claim 2 in which;

(a) said pivoted means comprises a primary crank pivoted on said carriage and having a crankpin which engages said impression member, adjacent its print end, and (b) said control means comprises sliding means.

5. A printing mechanism as defined in claim 4 in which said printing means further comprises:

(a) a second crank, pivoted on said carriage, and having a crankpin thereon, (b) a second crankpin on said primary crank, (c) a link connecting said crankpin on said second crank and said second crankpin, and (d) said driving means comprising electromagnetic means that rotates said second crank to effect back and forth rotation of said primary crank and to effect squeezing of a type chip received by said impression member against said record medium during said printing operation by over-the-center toggle type action.

6. A printing mechanism as defined in claim 2 in which said driving means comprises:

(a) electromagnetic means for driving said pivoted means to move said impression member from said chip-exchange position to said printing position, and (b) a bi-directional electromagnetic actuator connected to drive said control means in a first direction to aid in moving said impression member toward said printing position, effect squeezing of a type chip received by said impression member against said record medium, and then apply force in an opposite direction to effect return of the impression member to said chip-exchange position.

7. A printing mechanism as defined in claim 2 in which;

(a) said impression member has a control end spaced apart from said print end, and (b) said pivoted means comprises a primary crank having a crankpin which engages and supports said impression member adjacent said print end, (c) said control means comprising a secondary crank, shorter than said primary crank, supported for rotation in the same plane as the primary crank, and having a crankpin which engages and supports said impression member at said control end, (d) said primary crank and said secondary crank being so pivoted on said carriage that when said impression member is in said printing position and said printing mechanism is viewed from the side, said primary crank extends downward from its respective crankpin in a direction which is parallel to the plane of a type chip, when such chip is in printing position and said control crank extends upward from its respective crankpin in a direction which is also parallel to said last-mentioned plane.

* * * * *